United States Patent [19]

Schlunt et al.

[11] Patent Number: 4,843,587

[45] Date of Patent: Jun. 27, 1989

[54] PROCESSING SYSTEM FOR PERFORMING MATRIX MULTIPLICATION

[75] Inventors: Richard S. Schlunt, Loma Linda; Stephen W. Decker, Sunland, both of Calif.

[73] Assignee: General Dynamics Pomona Division, Pomona, Calif.

[21] Appl. No.: 131,478

[22] Filed: Dec. 10, 1987

[51] Int. Cl.[4] ..... G06G 7/16; G06G 9/00

[52] U.S. Cl. ..... 364/841; 364/822; 364/837

[58] Field of Search ..... 364/822, 837, 841; 350/96.11, 330

[56] References Cited

U.S. PATENT DOCUMENTS

| | | | |
|---|---|---|---|
| 2,702,158 | 2/1955 | Winter | 364/845 |
| 2,787,188 | 4/1957 | Berger | 364/822 |
| 3,305,669 | 2/1967 | Fan | 364/845 |
| 3,488,106 | 1/1970 | Lohmann | 364/827 |
| 3,492,469 | 1/1970 | Silverman | 364/841 |
| 3,588,486 | 6/1971 | Rosen | 235/194 |
| 3,592,547 | 7/1971 | Noble | 356/71 |
| 3,872,293 | 3/1975 | Green | 235/181 |
| 3,937,942 | 2/1976 | Bromley et al. | 235/181 |
| 4,120,035 | 10/1978 | Cases et al. | 364/602 |
| 4,286,328 | 8/1981 | Bocker | 364/851 |
| 4,365,310 | 12/1982 | Green | 364/822 |
| 4,747,069 | 5/1988 | Grinberg et al. | 364/841 X |

*Primary Examiner*—Steven Mottola

*Attorney, Agent, or Firm*—Neil F. Martin

[57] ABSTRACT

An optical processing system for performing a matrix multiplication Mx where M is a matrix and x is a vector involves two two-dimensional arrays of optically transmissive elements with each element of the first array communicating light to the corresponding element of the second array. The optical transmittance of each row of one of the arrays is controlled according to the values of the vector x, and the optical transmittance of each element of the other array is controlled according to the corresponding matrix value m(i,j). The first array is uniformly illuminated and the amount of light transmitted through the two arrays is detected by a suitable array of photodetectors. The output of each photodetector will be proportional to the sum of the products of the vector x(i) with each value of the matrix in the corresponding column of the matrix array.

10 Claims, 2 Drawing Sheets

PROCESSING SYSTEM FOR PERFORMING MATRIX MULTIPLICATION

BACKGROUND OF THE INVENTION

The present invention relates to an optical processing system capable of performing matrix calculations, such as matrix multiplication.

Image processing, spectrum analysis, signal analysis and other areas of data processing require the transformation of data via a linear operator which is represented in the form of a matrix. Mathematically, the operator is denoted by $$y = M\,x \tag{1}$$

where M is the matrix m(i,j), i=1,m . . . R and j=1. . . S (i.e. a matrix with R rows and S columns) and x is an R element row or column vector x(i),having the values i=1, . . . R. The value m(i,]) represents the element in the ith row and the jth column of the matrix. The value y is represented by the series [y(l) . . . y(S)]where $$y(k) = \sum_{i=1}^{R} m(i,k)x(i)$$

It can be seen that the generation of y(k) requires R multiplications and R additions, and this process must be repeated S times for all values of the vector y to be calculated. Thus the linear transform of data becomes computationally intense for relatively large values of R and S and real time applications are limited. The multiplication and addition process can, of course, be performed by a computer but the mathematical manipulations will then be carried out sequentially and may take an unnecessarily large length of time or require a costly, complex and relatively large computer system, which is not suitable where space or weight is limited.

Optical processing systems have been used in the past for performing mathematical manipulations involving matrices with large numbers of elements, since such systems can perform a large number of parallel additions and multiplications simultaneously.

Such systems typically involve the direction of one or more beams of light through an optical mask of variable transmittance. The intensity of the light beam or beams is adjusted according to a first set of values, and the transmittance of predetermined areas of the mask is controlled according to a second set of values. Thus if the light beams incident on each area or element of the mask are controlled in accordance with the vector x and the transmittances of the respective elements of the mask are controlled in accordance with the values of the matrix M, a solution for the equation (1) above can be obtained by measuring the amount of light passing through the mask. This is done by suitably arranged photodetectors.

In U.S. Pat. No. 3,592,547 of Noble, for example, analog data to be transformed is entered on a column of resolution elements by suitable control of the optical transmissivity of the elements, and a matrix transform function is entered on an array of resolution elements in a similar manner. Light projected through the column of elements is imaged on the array by means of a lens which images light from each element in the column on the corresponding row of elements in the matrix array. Light transmitted through each element of the array is proportional to the product of the data entered in that element with the data entered in the corresponding element of the column. The output from the array is detected by a suitable arrangement of photodetectors and can be converted into electrical signals representative of the results of a matrix multiplication.

In U.S. Pat. No. 4,286,328 of Bocker an optical system is used to perform the computation of the radar ambiguity function or similar mathematical computations. The system includes a programmable mask for storing a set of values, and a light source is positioned to illuminate the mask and have its intensity modulated as a function of the sample values. The image reflected from the array is directed onto a photosensor array to yield the ambiguity or other function.

In U.S. patent application Ser. No. 565,052 filed Dec. 23, 1983 and assigned to the same assignee as the present application, an optical matrix multiplier is described which has the capability of handling a linear multiplication operation involving a matrix having bipolar values. A light source produces a plurality of light beams w ith the intensity of each beam representative of a predetermined value of a known column vector. The beams illuminate a mask having individual elements forming a matrix having an extra row to generate an offset in the matrix values to ensure that the matrix has only unipolar values. The resultant output from the photodetectors can be adjusted to subtract the scalar constant generated by the additional row of the matrix.

Some of the known optical processing systems for performing complicated mathematical computations are relatively large or complex, require a large number of optical components, and are subject to errors unless perfectly aligned. In some cases, a photographic mask or film is used to simulate the matrix with the result that the device is not programmable.

SUMMARY OF THE INVENTION

According to the present invention an improved optical processing system for performing matrix multiplication is provided, which includes two two-dimensional matrix arrays of optically transmissive elements. One of the arrays has the tranmissivity of elements in each of its rows or columns controlled in accordance with components of a vector x and the other array has the transmissivity of each of its elements controlled in accordance with components of a matrix M. The arrays are disposed with elements of each array in registration with corresponding elements of the other array, and a first one of the arrays is uniformly lit by a suitable light source. Thus the intensity of light transmitted through each pair of aligned elements of the two arrays will depend on the product of the transmittance of the two elements and will be proportional to the product of one of the vector values with one of the matrix values.

Thus if all the light directed through a particular column j of the matrix is directed onto a suitable photodetector, the output of the photodetector will be proportional to $$y(j) = \sum_{i=1}^{R} x(i)m(i,j) \tag{3}$$

where the matrix has R rows.

Thus the result of the matrix multiplication can be obtained from the magnitude of the electrical signals produced from a suitable array of photodetectors for receiving light transmitted through each column of the aligned matrix arrays. Alternatively, the vector may be arranged as a column vector with the photodectectors arranged in a column to receive the light transmitted through each row of the array.

In a preferred embodiment of the invention the two arrays comprise transmissive liquid crystal displays, which are arranged either in face to face contact or close enough together to limit dispersion of light between corresponding elements of the two arrays. The outer face of the first array is uniformly illuminated by a suitable light source, and either a lens, fiber optic connections or other suitable light guides are provided to direct light transmitted through the two arrays to the corresponding photodetectors.

This arrangement has the advantage that it can be provided as a single, compact unit of simple design and with relatively few optical components. It has low power consumption and does not involve significant optical alignment problems.

The optical processing system may be designed to handle either negative matrix values or negative vector values. In the first case an extra column is provided in each array to add a factor N such that each matrix value will be positive. Subsequent mathematical manipulations of the outputs of the respective photodiodes can be carried out with suitable circuitry to produce the desired result. In the second case each vector value has a bias B added to it such that each resultant vector value is positive and the two arrays are expanded to include an additional array for producing the matrix multiplication M.B. The extra array has the value of the bias B encoded in it so that the outputs can be manipulated to subtract the resultant matrix constant M.B from the output M.(x +B) of the basic array to produce the desired product of M.X.

The system may be designed to perform a multiplication of two matrices instead of a row or column vector with a matrix.

BRIEF DESCRIPTION OF THE DRAWINGS

The present invention will be better understood from the following detailed description of some preferred embodiments of the invention, taken in conjunction with the accompanying drawings, in which like reference numerals refer to like parts and in which.

DESCRIPTION OF THE PREFERRED EMBODIMENTS

Figure 1:
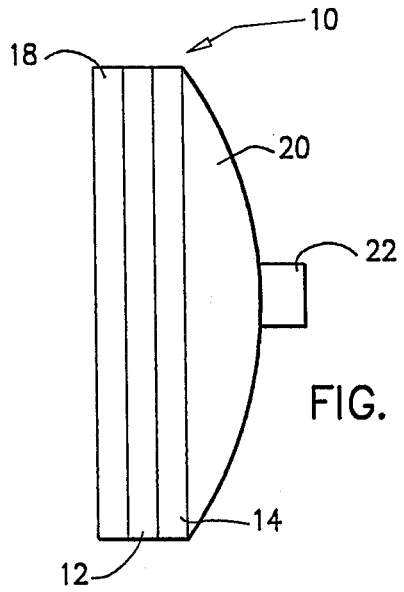
FIG. 1 is a side view schematic representation of the arrangement of the components of an optical processing system according to one embodiment of the present invention.
Figure 2:
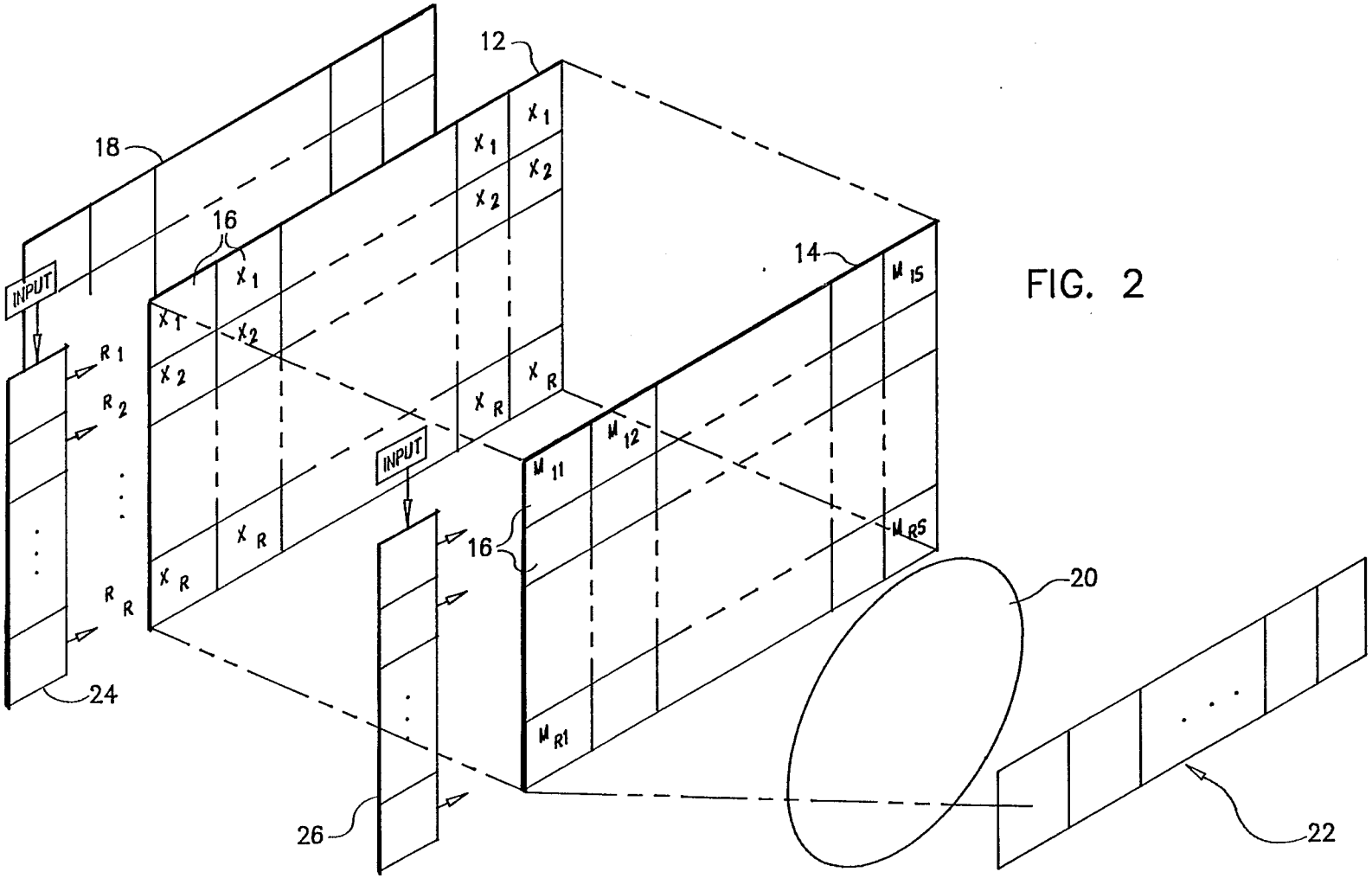
FIG. 2 is a schematic perspective view showing the separate components of the system of FIG. 1 and illustrating the two masks of the system each having areas of varying transmittance disposed in rows and columns to form a two-dimensional matrix.

FIG. 1 illustrates a first embodiment of an optical processing system for performing matrix multiplication according to the present invention. The system 10 basically comprises two optically transmissive masks 12, 14 each having a plurality of optically transmissive elements 16 disposed in a matrix of R rows and S columns, as best shown in FIG. 2. The first mask 12 is illuminated by a planar uniform light source 18 which illuminates the entire area of its outer face equally. The light source may be any suitable device for producing a uniform plane of illumination, such as a fluorescent lamp or a single light source expanded by means of a lens.

The light output of the second mask 14 is directed by a suitable guide such as the cylindrical lens 20 as shown in FIG. 1 or fiber optic connections onto an array of photodetectors 22 such as photodiodes. A suitable electrical circuit (not shown) is connected to the outputs of the photodiodes to manipulate the individual outputs to produce the desired mathematical computation. The photodiodes 22 are provided in a single row of S elements with each photodiode in the row receiving the output from all the elements in a corresponding column of the array 14, as shown in FIG. 2.

The masks 12, 14 can comprise any suitable light transmissive device or material with individual locations corresponding to the elements 16 for providing different values of light transmittance. They may, for example, be photographic plates or film or any two dimensional spatial light modulator such as back light transmissive liquid crystal displays (LCD's). The mask elements are preferably programmable to allow any desired values to be entered.

As shown in FIG. 2, the first mask 12 has values of a vector x entered in each of its rows, with the components x(i) of the vector controlling the transmittance of the elements in the corresponding row of the array. Thus each element in the first row will have a transmittance proportional to X(l), the second row elements will be proportional to X(2) and so on. If the mask is an LCD, the vector input x will be loaded serially line by line into the array in a conventional manner for liquid crystal display systems. The loading is accomplished via serial to parallel converter 24. A suitable microprocessor (not shown) may be provided for controlling the input values x(i). Although the values of the vector in this embodiment are entered row by row, it will be understood that they may alternatively be entered column by column, i. e. with the elements in each columnnn proportional to respective values of the vector. In this case the output photodiodes will be arranged in a single column rather than in a row as indicated in FIG. 2.

The second array 14 is preferably also an LCD. The array 14 comprises a mask holding the information contained in a matrix M having R rows and S columns, with each matrix entry m(i,j) controlling the transmittance of the display element 16 located in the ith row and the jth column of the array, as indicated in FIG. 2. The matrix values are loaded into the LCD row by row via serial to parallel converter 26 under the control of the microprocessor so that the values can be changed at will. For some specific applications, the mask LCD may be replaced by a photographic mask to simplify construction and reduce cost.

The two arrays are arranged such that light transmitted through each element of the first array is directed through the corresponding element of the second array. The arrays may be in face to face contact as indicated in FIG. 1, or may be spaced apart by a distance insufficient to allow any significant amount of light dispersion between the elements. Alternatively suitable light guides such as fiber optic connections may be provided between corresponding elements of the two arrays. When all the desired values of a vector x ($x=X_i \ldots x(R)$ and a matrix M (M m(ij) where i=1, . . . R and i=1, . . . R) have been loaded into the respective arrays by suitable control of the transmittance of the respective liquid crystal elements, and the first array is uniformly lit, the amount of light which will pass through each location (i,j) of the aligned arrays will be proportional to the product of x(i) and m(ij). Thus the result of the matrix multiplication $$y=M.x$$

will be proportional to the outputs of the photodiodes.

Since all the light passing through the jth column is focussed on or directed to the jth photodiode of the photodetector array, the output of that photodiode will be proportional to:

$$y(j) = \sum_{i=1}^{R} x(i)m(i,j) \quad (4)$$

The outputs of all the photodiodes are connected to circuitry(not shown) which conventionally provides an electrical signal representative of the amount of light falling on the photodetector. These signals will be provided to conventional processing circuitry (not shown) for producing the desired results of the matrix multiplication M.x.

The result of equation (4) above is based on the premise that $m(i,j) \geqq 0$ and $x(i) \geqq 0$, since light can be expressed only in unipolar quantities. However, the processing system can be modified to enable it to handle either negative values of m(i,j) or negative x(i) values.

Figure 3:
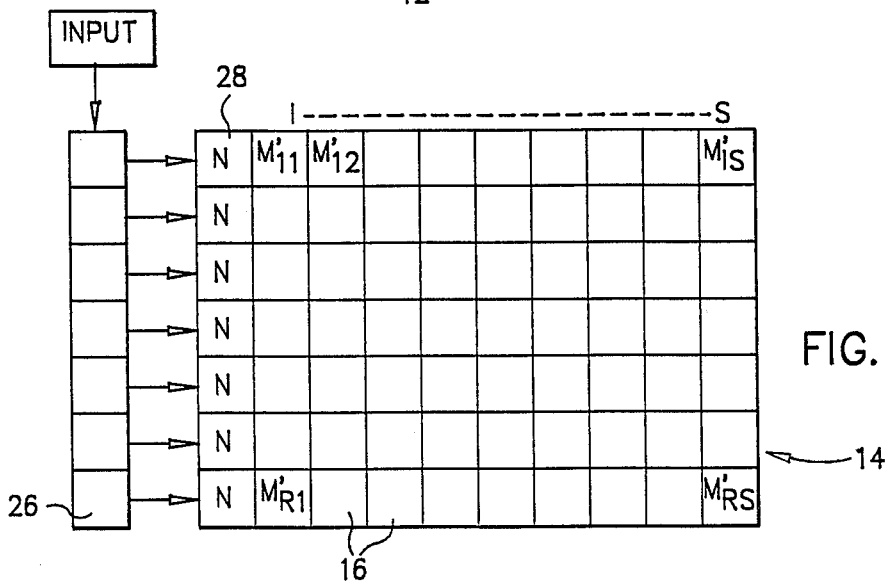
FIG. 3 illustrates one of the masks in an alternative embodiment of the invention.
Figure 4:
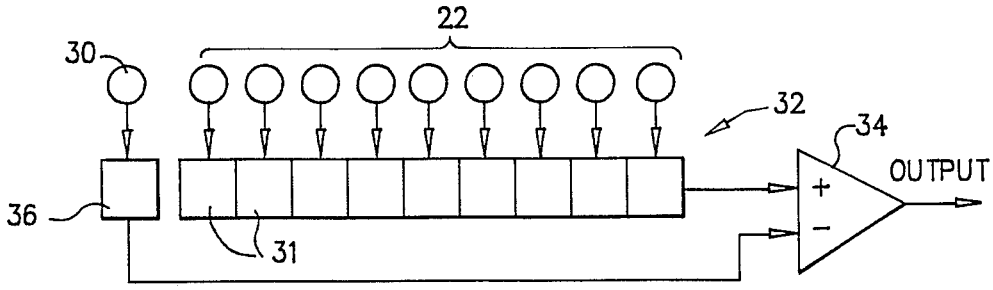
FIG. 4 is a block diagram illustrating an electrical circuit for mathematically manipulating the output of photodetectors receiving the output of masks configured as in FIG. 3.

FIGS. 3 and 4 show a modification to the system to enable it to handle negative values of the matrix M. If m(i,j) is negative, a constant N can be found such that $m'(i,j)=m(i,j)+N$ is positive for all i and all j. Each of the two arrays 12 and 14 is provided with a corresponding extra column 28. This is illustrated for the array 14 in FIG. 3. The rows of the first array are loaded with the values of x as in the first embodiment, while the each element of the extra column of the second array 14 has a transmittance proportional to the constant N and the rest of the elements have transmittances proportional to the corresponding values of m'(i,j).

Now the output of the jth photodiode will be $$y(j) = \sum_{i=1}^{R} (x(i)m(i,j) + N)) \quad (5)$$

An extra photodiode 30 is provided in the array for receiving the outputs from elements in the extra row, and this photodiode will have an output proportional to $$N \sum_{x=1}^{R} x(i) \quad (6)$$

Subtracting (6) from (5) gives equation (4). This subtraction can be accomplished by circuitry as generally indicated in FIG. 4. Each photodiode of the array 22 is connected to a corresponding channel 31 of a charge coupled device delay line 32 which is connected to one of the inputs of an operational amplifier 34. The photodiode 28 corresponding to the extra column is connected via charge coupled device 36 to the opposite input of the amplifier 34. Thus the output signal from amplifier 32 will be proportional to the result of subtracting equation (6) from equation (5) above. Where the vector x is arranged as a column vector rather than a row vector, the same manipulation can be carried out by adding an extra row to the arrays in a similar manner.

An alternative modification will enable the system to handle computations involving negative x(i) values. A bias B is added to each element in the first array, such that the first array contains values $x'(i)=x(i)+B$ which are all positive. The first array is expanded to include an additional of equal size o the first in an extra array of an equal number of elements array with each element having a transmittance proportional to B. The second array is also expanded to repeat the values of the matrix M so that the output of the two extra arrays will be proportional to the product of the scalar value B with the matrix M. The row of photodiodes will also be expanded to include an extra row of photodiodes for receiving the outputs of each column of the extra array.

The extra diodes will be connected as shown in FIG. 4 via a charge coupled device delay line to the negative input of the operational amplifier 36. Since the output of the original two arrays will be the result of the matrix multiplication M(x+B) and the output of the additional arrays will be the result of M.B, the subtraction of these two results will produce the desired result of the multiplication M.x.

With the optical processing device as described above using back light transmissive LCD's for the two arrays it is possible to perform a 512 point Fourier transform in the time it takes for the crystals to orientate themselves. The system is simple, fully programmable, and compact, and can be constructed as a single relatively lightweight unit as indicated in FIG. 1, making it extremely useful for processing operations in applications where space is limited. It can be programmed at will to handle sequential matrix multiplications and can be configured to handle relatively large matrices in a relatively small size unit. It will have very low power consumption and optical alignment problems will be reduced or eliminated because of the uniform illumination and the use of a minimal number of lenses. In fact the system may use fiber optic connections in place of the final lens to direct the output to the photodiodes to remove any critical alignment problems.

The system of this invention may be used in any area of data processing requiring the solution of a matrix multiplication, such as Fourier transforms, image processing, spectrum analysis, signal analysis, optical correlation, and so on.

Although some preferred embodiments of the invention have been described above by way of example, it will be understood by those skilled in the field that modifications may be made to the disclosed embodiments without departing from the scope of the invention, which is defined by the appended claims.

We claim:

1. An optical processing system for performing matrix multiplication, comprising:

two optically transmissive masks each including a plurality of individual elements disposed in a two dimensional matrix, the matrices being of equivalent size and the masks being aligned in series such that elements of the first mask are in registration with corresponding elements of the second mask;

data input means for controlling the optical transmittance of each element of one of the masks in accordance with a set of values of a vector x, and controlling the optical transmittance of each element of the other mask in accordance with corresponding values of a matrix M;

light source means for uniformly illuminating the outer face of the first mask; and photodetection means positioned to receive light transmitted through the two masks for determining the intensity of light received and for producing an output signal representative of the product of said vector x with said matrix M.

2. The system as claimed in claim 1, wherein the transmittances of the elements of at least one of said masks are selectively programmable.

3. The system as claimed in claim 2, wherein said programmable mask is a transmissive liquid crystal display.

4. The system as claimed in claim 3, wherein both of said masks comprise transmissive liquid crystal displays.

5. The system as claimed in claim 1, wherein each of said masks is programmable and said data input means comprises computer means for entry of data into said masks.

6. The system as claimed in claim 1, wherein said masks are positioned in face to face contact.

7. The system as claimed in claim 1, wherein the components of said system are provided as a single unit.

8. The system as claimed in claim 1, wherein said data input means controls the optical transmittance of the elements in each row of the first mask in accordance with respective values of a vector x, and said photodetection means includes a series of photodetectors and light guide means for directing light transmitted through each column of the second mask to a respective one of said series of photodetectors.

9. The system as claimed in claim 1, wherein each mask defines a matrix having R rows and S+1 columns, said data entry means comprises means for controlling the transmittance of each element of S columns of said other mask in accordance with the sum of a predetermined value of a known R×S matrix and a constant N, and for controlling the transmittance of each element in the remaining column in accordance with the value of the constant N, and said 1098APA.Cl9] photodetection means includes means of detecting the light transmitted through the S columns of said two masks and for producing a first output signal representative of the intensity of said transmitted light, and means for detecting the light transmitted through said extra column and for producing a second output signal representative of said transmitted light, and further including signal processing means for subtracting said second output signal from said first output signal to produce an output representative of the product of said vector with said known R×S matrix.

10. The system as claimed in claim 1, wherein each of said matrices has R rows and 2S columns, said data entry means comprising means for entering values of a vector x plus a constant bias B in the first S columns of one of the matrices, means for entering the constant bias B in each element of the second S columns of that matrix, and means for entering values of a known R×S matrix in the first and the second S columns of the other matrix, and said photodetection means comprises means for detecting the light transmitted through the first S columns of the two matrices and for producing a first output signal representative of the intensity of the detected light, and means for detecting the light transmitted through the second S columns of the two matrices and for producing a second output signal representative of the intensity of the detected light, and further including signal processing means for subtracting said second output signal from said first output signal and producing a resultant output representative of the product of said vector x with said R×S matrix.

* * * * *

UNITED STATES PATENT AND TRADEMARK OFFICE

CERTIFICATE OF CORRECTION

PATENT NO. : 4,843,587

DATED : June 27, 1989

INVENTOR(S) : Schlunt, et al.

It is certified that error appears in the above-identified patent and that said Letters Patent is hereby corrected as shown below:

Column 8, claim 9, line 4, please delete 1098APA.C19]

Signed and Sealed this

Second Day of October, 1990

*Attest:*

HARRY F. MANBECK, JR.

*Attesting Officer*

*Commissioner of Patents and Trademarks*